US005297990A

United States Patent [19]

Renz et al.

[11] Patent Number: 5,297,990

[45] Date of Patent: Mar. 29, 1994

[54] FILTER-VENTILATOR-ARRANGEMENT

[75] Inventors: Manfred Renz, Ditzingen; Helmut Bauer, Tamm, both of Fed. Rep. of Germany

[73] Assignee: Meissner & Wurst GmbH & Co., Stuttgart, Fed. Rep. of Germany

[21] Appl. No.: 828,154

[22] Filed: Jan. 30, 1992

[30] Foreign Application Priority Data

Feb. 1, 1991 [JP] Japan ..... 4103026
Oct. 5, 1991 [DE] Fed. Rep. of Germany ..... 4133093

[51] Int. Cl.[5] ..... F24F 13/24

[52] U.S. Cl. ..... 454/187; 55/276; 55/385.2; 55/473; 181/225; 454/338; 454/906

[58] Field of Search ..... 55/276, 473, 385.2; 181/225; 454/187, 251, 338, 906

[56] References Cited

U.S. PATENT DOCUMENTS 1,685,701 9/1928 Blanchard ..... 454/906 X
4,549,472 10/1985 Endo et al. ..... 454/251 X

FOREIGN PATENT DOCUMENTS 157432 9/1984 Japan ..... 454/187
282449 11/1988 Japan ..... 454/906

*Primary Examiner*—Harold Joyce
*Attorney, Agent, or Firm*—Albert H. Reuther

[57] ABSTRACT

A filter-ventilator-arrangement for employment with clean chambers with at least one ventilator of which the pressure side is located toward an air flow chamber which is limited by boundary walls including a flow chamber formed by at least one annular channel of which one of two boundary walls at least consists of a noise-damping material. Furthermore at least an outer boundary wall consists of noise-damping material. The arrangement includes modular units having several annular channels of which the boundary walls decrease in height from the outside to the inside. Each unit has at least one filter which is arranged in a region below the flow chamber. Innermost boundary walls with inner sides thereof adjoin a plate consisting of noise-damping material. The boundary walls are secured, hanging or suspended on the cover sealing part. At least one heat exchanger lies in a suction region of the ventilator via which the return air flows.

8 Claims, 5 Drawing Sheets

FILTER-VENTILATOR-ARRANGEMENT

The present invention relates to a filter-ventilator-arrangement or installation of equipment for employment with clean rooms, spaces or chambers, with at least one ventilator means, of which the pressure side is directed toward an air flow chamber or space, that is bounded or limited by boundary walls.

DESCRIPTION OF THE PRIOR ART

It is known to embody or construct the filter-ventilator-arrangement together with the clean room or space as a unit. Near a side wall of this unit there is located the ventilator, with which the cool air is suctioned or drawn thereto and conveyed into the air flow chamber or space, which extends from the ventilator horizontally as far as to an oppositely located wall, there having a 180° turn around or change of direction being bounded or limited downwardly by a filter means lying with spacing below the lower boundary wall. As a consequence of this arrangement or design there result for the air great or large flow courses or paths, which lead to correspondingly high flow loses and with that to correspondingly high energy requirement. As a consequence of this air guidance it is also possible to attain a uniform flow distribution over the filter surface only with very great difficulty. Additionally this arrangement has a comparatively high sound pressure volume or pegel level.

SUMMARY OF THE INVENTION

An object of the present invention is to embody or construct the generic filter-ventilator-arrangement in such a manner that with a compact construction or arrangement it has a high noise deadening or damping or checking and reduction of noise, the uniform flow distribution as well as small or nominal flow losses and a small or nominal energy requirement.

This object is resolved with the generic filter-ventilator-arrangement having inventive improvements as set forth and covered in the following disclosure. Accordingly, with the present inventive arrangement, the flow space or chamber is constructed as an annular duct or channel, which as a consequence of the ring or annular-shaped construction and embodiment must have only small or nominal height. Consequently, the present inventive arrangement and apparatus can be constructed and embodied in a very compact manner. A uniform flow distribution as well as a uniform speed or velocity over the filter surface are made possible with the annular duct or channel, so that the air can enter uniformly through the filter into the clean space or chamber located therebelow. Also, only very short flow courses or paths are provided as a consequence of the annular duct or channel, whereby also small or nominal flow loses and correspondingly also only a very small or nominal energy requirement results.

With the present inventive filter-ventilator-arrangement furthermore the return air suctioned by the ventilator flows over or via the heat exchanger before it reaches the ventilator and hereby discharges or gives off warmth or heat. Consequently, the return air is cooled in an adequate extent or measure before entry into the clean space or chamber which is located in a region below the filter-ventilator-arrangement. The heat exchanger is arranged advantageously in a scope or region of the inlet opening for a return air guidance of the present inventive arrangement and apparatus. Then the pressure loses are small or nominal because of the here prevailing small or nominal impinging or arrival flow speeds and velocities, so that only a very small or nominal energy requirement of the apparatus is necessary.

Further objects and advantages of the present invention are apparent from the following description and disclosure, reference being made to the drawings illustrating two example embodiments setting forth the features of the present invention in greater detail.

DESCRIPTION OF THE PREFERRED EMBODIMENTS

The filter-ventilator-units according to the illustrations of FIGS. 1 through 6 inclusive are characterized and distinguishable by a high noise damping or reduction of noise and a uniform flow distribution with compact type of construction and arrangement. The units can be employed with all types of employment of clean spaces or chambers, for example in the field of medicine, in the field of pharmacy, in the field of biotechnology, in the field of electronics and in the field of semiconductor techniques. The filter units are adapted and suitable especially for small clean room or space regions, for a post or subsequent installation of already existing clean-room or space regions and for local clean rooms or spaces. The clean spaces or chambers can be arranged and constructed or built-up in a modular and with that flexible manner with the units in accordance with the present invention so that the clean space or chamber regions at all times can be changed, varied, and/or supplemented at any time for example as a consequence of technical advance. In this manner very quickly and in a cost advantageous manner there can be performed and carried out expansions, rearrangement or change or construction as well as improvements of the clean space or chamber class.

Figure 1:
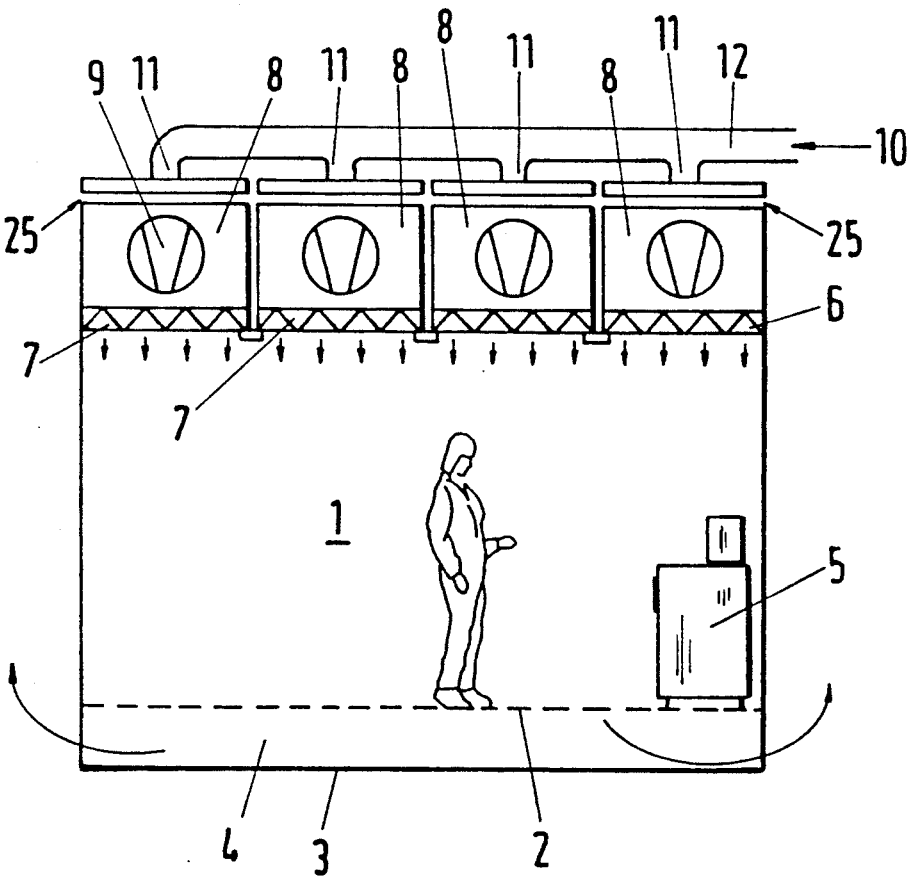
FIG. 1 is a view that shows a schematic illustration of a clean space or chamber provided with filter-ventilator-units in accordance with the arrangement of the present inventive teaching.

FIG. 1 shows a clean room or space 1, which has a bottom floor 2 permeable for air. The clean room or space is located lying with spacing above a floor or bottom 3 impermeable as to air, which bottom or floor 3 together with the permeable bottom or floor 2 bounds or limits a return air guide means 4. A processing device 5 is located in the clean space or chamber 1. The clean space or chamber 1 is bounded or limited upwardly by a ceiling or cover 6 which is formed or constructed in a raster form or manner by filters 7 of the filter-ventilator-units 8. The filter-ventilator-units 8 are embodied and constructed as modules, which are arranged sequentially and adjoining or next to each other for formation of the raster ceiling or cover 6. The individual filter-ventilator-units 8 are individually interchangeable quickly in an advantageous manner so that eventual repairs and service maintenance work can be carried out in a simple and straight forward manner and quickly or rapid time.

Each unit 8 respectively has at least one ventilator 9, with which cool air 10 and return air 25 is capable of being suctioned or drawn therewith and being conveyed through the filter 7 into the clean space or chamber 1. The filtered air flows at least substantially in a laminar manner vertically or at right angles downwardly to the bottom or floor 2, discharging therethrough and diverted or redirected at the lower, closed bottom or floor 3 and then such air flows out in the return air guide means 4 to the outside (compare arrows in FIG. 1). For the cool air supply, each filter-ventilator-unit 8 is provided with a cool air connection 11. As schematically shown and illustrated by FIG. 1, several cool air connections 11 respectively are joined or connected to a common supply line or conduit 12.

The filter-ventilator-units 8 are embodied and constructed as modules respectively and advantageously in an identical manner. These units 8 are described in further detail individually on the basis of the illustrations of FIGS. 2 and 3. The unit 8 in the sample embodiment has an approximately quadratic outline or configuration, but however also can have a rectangular or every other suitable outline or configuration. The quadratic respectively rectangular outline or configuration has an advantage that the cover or ceiling of the clean space or chamber 1 can be constructed and built up in a raster shape or configuration out of only a few units 8.

Figure 2:
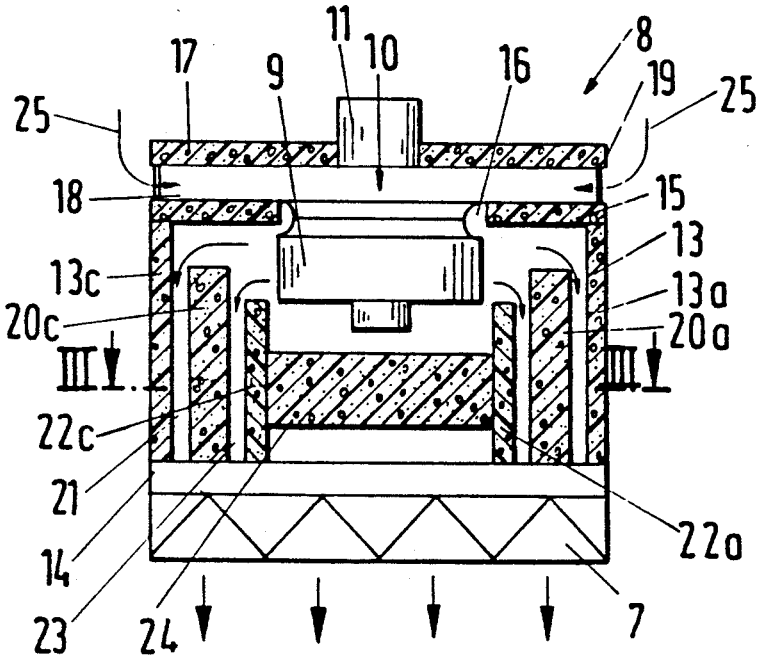
FIG. 2 is a view that shows a section through a present inventive filter-ventilator-unit arrangement.

The unit 8 has an outer wall 13 which is formed and constructed out of four right-angle wall parts 13*a*, 13*b*, 13*c* and 13*d* placed or arranged against each other. These parts extend upwardly from a bearing rest or support 14 (FIG. 2). The support 14 can be formed and constructed by profile rails, rods or bars and the like. Upon the wall parts 13*a*, 13*b*, 13*c* and 13*d* there is placed or installed a horizontal ceiling or cover part 15, which has the same and identical outline or configuration as does the unit 8. Centrally the ceiling part 15 has an opening 16, into which the ventilator 9 is inserted or installed. The ventilator 9 projects downwardly over the ceiling part 15. With spacing above the ceiling part 15 there is provided a further cover or ceiling part 17 that lies parallel to the cover or ceiling part 15 and together therewith bounds or limits and defines a return air guide means 18. The cover or ceiling part 17 can have the same outline and configuration as does the cover part 15 and is held longitudinally of the circumference or periphery by spacers 19 at a distance or spacing with respect to the cover or ceiling part 15. Preferably the cover or ceiling part 17 is slightly and nominally smaller than the cover or ceiling part 15. Consequently the suctioning of the return air is facilitated and made easier. The cover or ceiling part 17 naturally also can have a different outline or configuration than that of the cover or ceiling part 15. The spacers 19 are provided with non-illustrated inlet openings for the return air. The cover part 17 is provided centrally with a cool air connection 11, which is embodied and constructed as connection strut, brace or support means relative to which the supply line or conduit means 12 can be connected (FIG. 1). The cool air connection 11 accordingly is located with spacing above the ventilator 9 (FIG. 2). In order not to influence the flow conditions and relationships in the return air guide means 18, the cool air connection 11 advantageously does not project into the return air guide means 18, but rather lies flush concisely binding with the lower or underside of the cover or ceiling part 17. Likewise the ventilator 9 preferably does not project into the return air guide or conduit means 18, but rather lies flush concisely binding with the top or upper side of the cover or ceiling part 15 toward the cover or ceiling part 17.

With spacing to the outer wall parts 13*a*, 13*b*, 13*c* and 13*d* there are provided intermediate walls 20*a*, 20*b*, 20*c*, and 20*d*, which extend parallel to the wall parts 13*a*, 13*b*, 13*c*, and 13*d*, and which extend upwardly likewise from the rest or support 14. They terminate, however, with spacing from the ceiling part 15 (FIG. 2). The intermediate walls 20*a*, 20*b*, 20*c* and 20*d* have the same identical height and in the sample embodiment are thicker than the outer wall parts 13*a*, 13*b*, 13*c*, and 13*d*. Between the intermediate walls 20*a*, 20*b*, 20*c*, and 20*d*, and the outer wall parts 13*a*, 13*b*, 13*c*, and 13*d* there is formed a square ring or annular channel or duct 21, in which air suctioned by the ventilator 9 flows downwardly in a direction on to the filter 7.

Figure 3:
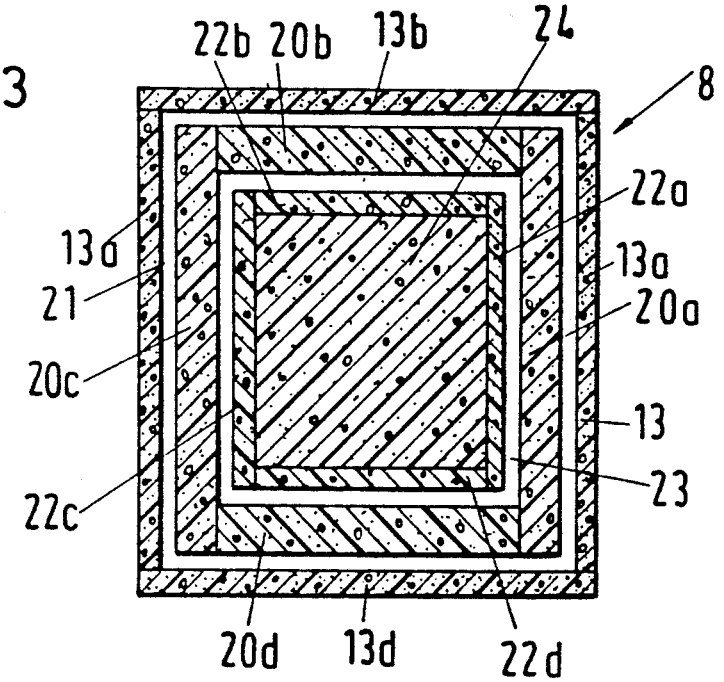
FIG. 3 is a view that shows a section taken longitudinally of a line III—III in FIG. 2.

Upon the side away from the outer wall parts 13*a*, 13*b*, 13*c*, and 13*d* there are arranged with spacing as to the intermediate walls 20*a*, 20*b*, 20*c*, and 20*d* the inner wall parts 22*a*, 22*b*, 22*c*, and 22*d*, which likewise extend upwardly from the space, rest or support 14 and parallel to the intermediate walls. The inner wall parts have smaller or more nominal height than the intermediate wall. 20*a*, 20*b*, 20*c*, and 20*d* (FIG. 2). The inner wall parts 22*a*, 22*b*, 22*c*, and 22*d* close again at right angles against each other and limit or bound together with the intermediate walls 20*a*, 20*b*, 20*c* and 20*d* to define a further square ring or annular channel or duct 23 (FIG. 3). As apparent from FIG. 2, the inner wall parts 22*a*, 22*b*, 22*c*, and 22*d*, as seen in a plan view, surround the ventilator 9 with a small or nominal spacing.

The space or chamber enclosed or surrounded by the inner wall parts 22*a*, 22*b*, 22*c*, and 22*d* is closed by a plate 24 in a direction upon the filter 7. As FIG. 3 shows, the plate 24 fills out the inner space or chamber surrounded or enclosed by the wall parts 22*a*, 22*b*, 22*c*, and 22*d*. As FIG. 2 shows, the plate 24 is fastened or secured approximately at half the height on the inner sides of the wall parts 22*a*, 22*b*, 22*c* and 22*d*.

All wall parts 13*a*, 13*b*, 13*c*, and 13*d*; 20*a*, 20*b*, 20*c*, and 20*d*; and 22*a*, 22*b*, 22*c*, and 22*d* are fastened or secured on the rest or support 14 which can be formed by profile rails and the like. It is also possible to fasten or secure the wall parts 13*a*, 13*b*, 13*c*, and 13*d*; 20*a*, 20*b*, 20*c*, and 20*d*; and 22*a*, 22*b*, 22*c*, and 22*d* hanging or suspended on the cover or ceiling part 15, for example with threaded rods or bars.

With the spacing below the wall parts 13*a*, 13*b*, 13*c* and 13*d*; 20*a*, 20*b*, 20*c*, and 20*d*; and 22*a*, 22*b*, 22*c*, and 22*d* there is provided a filter 7, which either is a component of the unit or is a separate structural part, that is connected with the unit during the assembly thereof.

All wall parts 13*a*, 13*b*, 13*c* and 13*d*; 20*a*, 20*b*, 20*c*, and 20*d*; 22*a*, 22*b*, 22*c*, and 22*d* consist of noise-damping material, such as mineral wool, foam materials or the like. Advantageously also the cover or ceiling parts 15 and 17 consist of noise-damping material. Consequently there results a very high noise-damping of the filter-ventilator-unit 8. Advantageously also the plate 24 consists of noise-damping material. Since the individual walls are constructed and assembled of wall parts, they can be assembled and brought together out of prefabricated parts. Consequently, as required also only individual wall parts can be interchanged so that not the entire wall must be interchanged or replaced upon encountering damage or wear of only one wall part. Naturally, the wall parts 13*a*, 13*b*, 13*c*, and 13*d*; 20*a*, 20*b*, 20*c*, and 20*d*; and 22*a*, 22*b*, 22*c*, and 22*d* respectively also can be constructed or made unitary or integrally with each other.

The filter 7 consists of conventional material and can be so embodied and constructed that it is suitable and adapted for clean spaces or chambers as far as to at least Class 1.

Cooling air is suctioned by the ventilator 9 centrally via the cool air connection 11 (FIG. 2). Simultaneously the return air (arrows 25) is suctioned by the ventilator 9 via the return-air guide means 18. Since the cooling air connection 11 is located centrally of the ventilator 9 and the return air is suctioned transversely or at right angles thereto, the cooling air is mixed well with the return air 25, whereby also a quick and rapid temperature equalization is attained. The suctioned air is guided from the ventilator 9 in the direction of the arrows in FIG. 2 into the ring or annular channels or ducts 21 and 23 and is guided diverted therein vertically or at right angles downwardly to the filter 7. After the passage thereof through filter 7, the cleansed air comes into the clean space or chamber 1 (FIG. 1). The graduation or modulated arrangement of the wall parts 13*a*, 13*b*, 13*c*, and 13*d*; 20*a*, 20*b*, 20*c*, and 20*d*; and 22*a*, 22*b*, 22*c*, and 22*d* inwardly is so selected that a uniform speed or velocity is attained over the filter surface. With that accordingly the filter-ventilator-unit 8 is characterized and distinguished by a uniform flow distribution with compact construction manner and high noise damping. The flow courses or paths from the ventilator 9 to the filter 7 are extremely short as a consequence of the ring or annular channel or duct, so that only very small or nominal flow loses and with that also only a very small or nominal energy requirement result. As a consequence of the ring or annular channels or ducts 21, 23, the individual wall parts can be comparatively low, so that in addition to the advantage of small or nominal flow loses also an extremely compact construction arrangement of the units 8 is attained. Since the ventilator 9 is arranged centrally, there results a uniform flow over the circumference or periphery and scope of the ring or annular channels or ducts 21 and 23.

The filter-ventilator-unit 8 can be hung or suspended on the ceiling or can be installed or inserted in a raster cover or ceiling. The units 8 can be inserted or installed both individually and also can be assembled or joined modular into clean spaces or chambers of suitable and desired size. Maintenance or service work on the units 8 influence the clean space or chamber operation only slightly. The individual filter-ventilator-units 8 can be exchanged individually, quickly and rapidly from below or from above. The exchange of the filter 7 is possible from below. The ventilators 9 are accessible from below, but also from above. Consequently maintenance-service work can be carried out over traversable units, without bringing to a standstill the entire clean space or chamber 1. Smaller and large clean spaces or chambers can be constructed and built-up in a cost-advantageous manner with the individual units 8. Particularly also post-equipping is possible in a cost advantageous manner with the filter-ventilator-units 8 constructed as modules. As a consequence of the compact embodiment and construction thereof, the filter-ventilator-units 8 also have only slight or nominal weight so that a simple and straight forward assembly is possible. Additionally the ceiling or cover load is comparatively small or nominal. With the most simple and straight forward embodiment there is noted that the filter-ventilator-unit 8 has only one ring or annular channel or duct, which is bounded or limited by the outer wall parts 13*a*, 13*b*, 13*c*, 13*d* and the inner wall parts 22*a*, 22*b*, 22*c*, 22*d*. Such a unit is moreover constructed more compact and additionally provides all advantages with respect to the high noise damping, the uniform flow distribution and the nominal flow loses being provided therewith. Hereby it is adequate and sufficient when only the one boundary wall, accordingly the wall parts 13*a*, 13*b*, 13*c*, and 13*d* or the wall parts 13*a*, 13*b*, 13*c*, and 13*d* consist of noise-damping material. Advantageously however all wall parts consist of noise-damping material, so that a very high noise-damping and noise reduction and suppression is attained.

With another non-illustrated embodiment or form there is noted that the filter-ventilator-unit 8 can provide more than two ring or annular channels or ducts. In this situation correspondingly more wall parts are provided which again in the height or level thereof are so adjusted and attuned as to each other that the wall height decreases from the outside to the inside. This graduation is again so selected that a uniform flow speed or velocity of the air is attained over the filter surface.

The units 8 accordingly are very well able to be fitted or adapted to the respective employment situations in a simple and straight forward manner, in that only a different number of wall parts is provided. All variations are characterized and distinguishable by the high noise-damping, the uniform flow distribution, the compact manner of construction, the nominal or small flow loss and by the small or nominal weight.

In place of the square cross sectional configuration or construction there is noted that the units 8 and the wall parts also can have every other suitable outline or configuration, for example a round outline or configuration.

Figure 4:
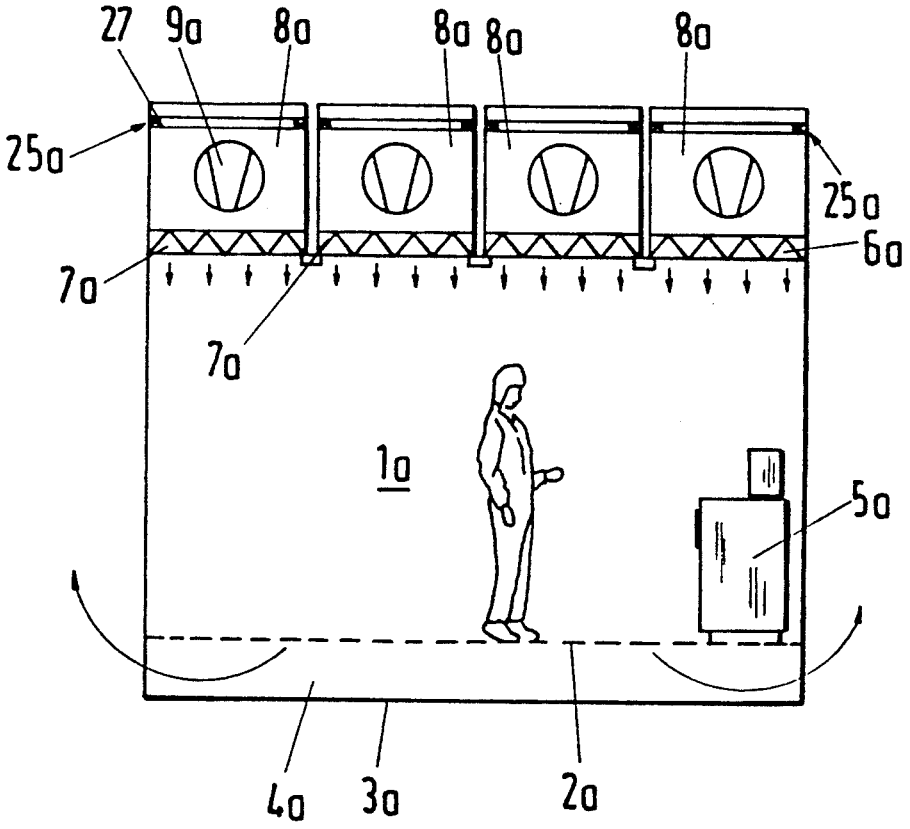
FIG. 4 is a schematic illustration of a clean space or chamber having a second embodiment of filter-ventilator-units arranged in accordance with the teaching of the present invention.

FIG. 4 shows a clean space or chamber 1*a*, which has the floor or bottom 2*a* permeable for air. This bottom or floor 2*a* is located with spacing above an air impermeable bottom or floor 3*a*, which together with the air permeable bottom or floor 2*a* bounds or limits a return air guide means 4*a*. In the clean space or chamber 1*a* there is located a processing device 5*a*. The clean space or chamber 1*a* is bounded or limited upwardly by a cover or ceiling 6*a*, which is constructed raster-shaped by filter 7*a* of the filter-ventilator-units 8*a*. The units are constructed as modules which are arranged adjoining or adjacent to each other and sequentially for formation of the raster cover or ceiling 6*a*. The individual filter-ventilator-units 8*a* can be individually interchanged quickly and rapidly in an advantageous manner so that eventual repairs and maintenance-service can be carried out in a rapid, and simple and straight forward manner.

Every unit 8*a* has at least one ventilator 9*a*, with which return air 25*a* is suctioned (FIG. 4 and FIG. 5) and is conveyed through the filter 7*a* into the clean space or chamber 1*a*. The filtered air flows in the illustrated sample embodiment at least substantially laminar vertically or at right angles downwardly to the bottom floor 2a, passes therethrough and being diverted or deflected at the lower, closed bottom or floor 3a and then flowing outwardly in the return air guide means 4a (compare arrow in FIG. 4). The filtered air naturally can also flow turbulently through the clean space or chamber la with the sample embodiment according to FIGS. 1, 2 and 3.

Advantageously the filter-ventilator-units 8a constructed as modules are respectively made identically embodied and constructed. These units 8a are described individually in greater detail with reference being made to FIGS. 5 and 6. The unit 8a in the sample embodiment has an approximately quadratic outline or configuration, but also can have rectangular or every other suitable configuration, for example a round outline. The quadratic respectively rectangular outline shape has the advantage that the cover or ceiling of the clean space or chamber 1a can be constructed in a raster shape or configuration out of only a few units 8a.

Figure 5:
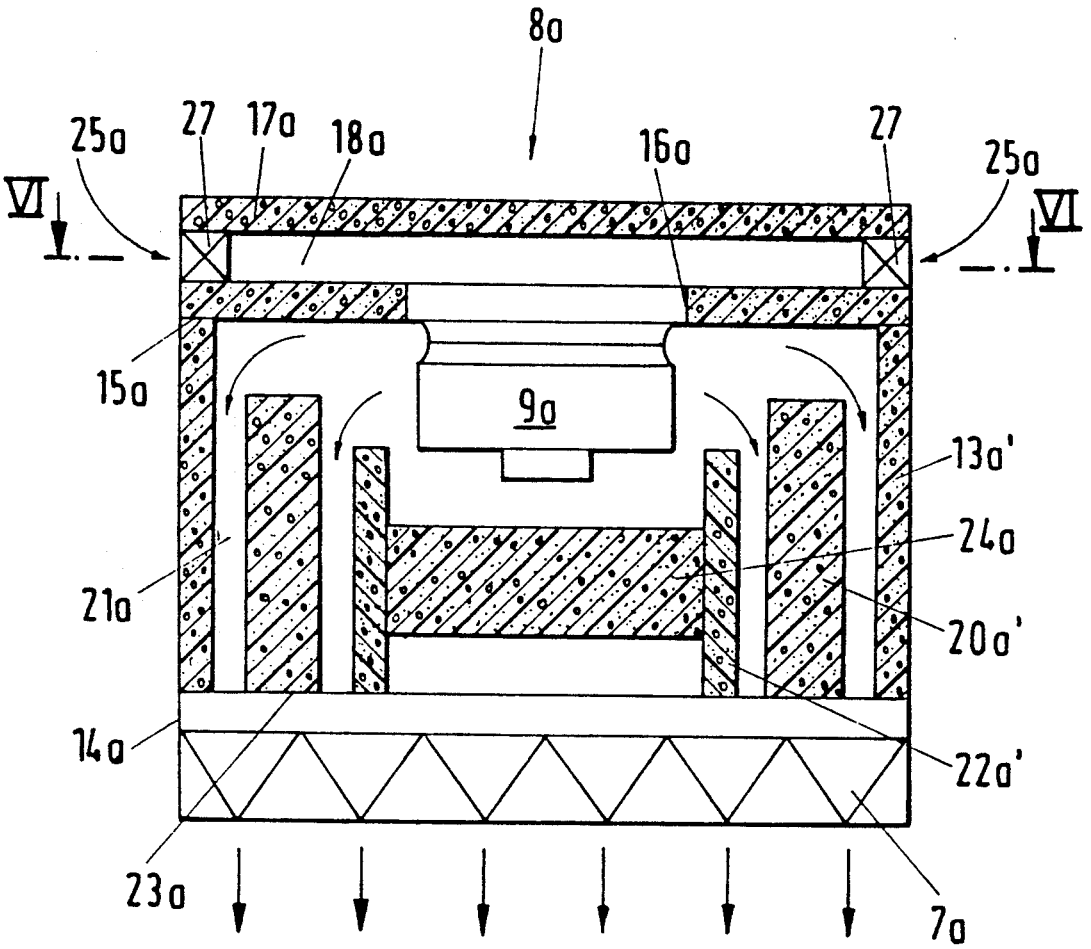
FIG. 5 is a view that shows an enlarged illustration of a section through a filter-ventilator-unit arrangement having inventive features shown according to FIG. 4.

The unit 8a has an outer wall 13a, which is formed and constructed out of four right-angle non-illustrated wall parts placed against each other. These wall parts extend upwardly from a support or rest 14a (FIG. 5). The support 14a can be formed and made via profile rails, rods, bars or the like. Upon the wall parts of the outer wall 13a' there is placed or installed a horizontal cover or ceiling part 15a, which has the same or identical outline as that of the unit 8a. Centrally the cover or ceiling part 15a has an opening 16a (FIG. 5 and FIG. 6), into which the ventilator 9a is inserted or installed. The ventilator projects downwardly over the cover or ceiling part 15a. With the spacing above the cover part 15a there is provided a further cover or ceiling part 17a which lies parallel relative to the cover or sealing part 15a and together with this defining limits or bounds of a return air guide means 18a. The cover or ceiling part 17a can have the same or identical outline or configuration as the cover or ceiling part 15a and is held in the region of the circumference or periphery by spacers 19a (FIG. 6) and a spacing as to the cover part 15a. With rectangular outline of the units 8a, the spacers 19a are provided at the corners of the cover or ceiling part 17a and preferably being formed by angular pieces standing on edge, on end or edgeways. Naturally the spacers 19a also can have every other suitable construction and embodiment. Preferably the cover or ceiling part 17a is slightly smaller than the cover or ceiling part 15a. Consequently the suctioning of the returned air is facilitated. The cover or ceiling part 17a naturally also can have other outline configuration than that of the cover or ceiling part 15a.

The ventilator 9a advantageously does not project into the return air guide means 18a but rather lies flush with, in a concisely binding manner, with the top or upper side of the cover or ceiling part 15a toward the cover or sealing part 17a.

With spacing to the outer wall 13a' there is provided an intermediate wall 20a', which extends parallel to the outer wall 13a' and which extends likewise upwardly from the support 14a. The intermediate wall 20a' with angular or cornered construction embodiment of the unit 8a beside the wall parts abutting against each other. The intermediate wall 20a' terminates with spacing from the cover or ceiling part 15a (FIG. 1 The intermediate wall 20a' over its peripheral circumference and scope has the same or identical height or level and in the sample embodiment is thicker than the outer wall 13a'. Between the intermediate wall 20a' and the outer wall 13a' there is formed a ring or annular channel or duct 21a, in which the air suctioned by the ventilator 9a flows downwardly in a direction onto the filter 7a.

On the side away from the outer wall 13a' there is arranged with spacing to the intermediate wall 20a' an inner wall 22a', which likewise extends from the support 14a upwardly and parallel to the intermediate wall 20a'. This inner wall has a smaller or more nominal height than the intermediate wall 20a (FIG. 5). The inner wall 22a' is formed by wall parts abutting against each other, which together with the intermediate wall 20a' defining limits or bounds of a further ring or annular channel or duct 23a. The inner wall 22a' surrounds the ventilator 9a with a small or nominal spacing as seen in a plan view upon the filter-ventilator-unit 8a.

The space or chamber enclosed or surrounded by the inner wall 22a' is enclosed by a plate 24a in a direction upon the filter 7a. The plate 24a fills out the inner space or chamber surrounded by the inner wall 22a'. As shown in FIG. 5, the plate 24a is secured at approximately half height to the inner side of the inner wall 22a'.

All wall parts of the outer wall 13a', of the intermediate wall 20a' and of the inner wall 22a' are fastened or secured upon the support 14a. It is also possible to fasten or secure these wall parts hanging or suspended on the cover or ceiling part 15a, for example with threaded rods or bars. With spacing below the walls 13a', 20a', 22a', there is provided the filter 7a, which is either a component of the filter-ventilator-unit 8a or a separate structural part, which is connected with the unit during the assembly or mounting thereof.

In the illustrated preferred sample embodiment all walls 13a', 20a' and 22a' consist of noise-damping material, such as mineral wool, foam material or the like. Advantageously also the cover or ceiling parts 15a and 17a consist of noise-damping material. Consequently there results a very high noise damping of the filter-ventilator-unit 8a. Also the plate 24a consists advantageously of noise-damping material. Since the individual walls 13a', 20a' and 22a' are assembled or joined out of wall parts, they can be assembled and constructed together out of prefabricated parts. Consequently as required also only individual wall parts can be interchanged or replaced, so that not the entire wall must be exchanged or replaced upon damaging or wear of only one wall part. Naturally the wall parts of the walls 13a', 20a' and 22a' respectively also can be constructed unitary or integrally with each other.

With the filter-ventilator-unit 8 the walls naturally need not consist of noise-damping material. Accordingly for the walls conventional material such as sheet metal plates or the like can be installed or inserted.

The filter 7a consists of conventional material. With that consequently the units 8a can be employed for all classes of clean spaces or chambers. The return air 25a is suctioned by the ventilator 9a via the return air guide means or duct 18a. The suctioned air is guided from the ventilator 9a in a direction of the arrows in FIG. 5 into the ring or annular channels or ducts 21a and 23a being guided or diverted therein vertically or at right angles downwardly as to the filter 7a. After passage through the filter 7a, the cleansed purified air comes into the clean space or chamber la (FIG. 4). The gradation of the walls 13a', 20a' and 22a' inwardly is so selected that a uniform speed or velocity is attained over the filter surface. With that consequently this filter-ventilator-unit 8a is characterized and distinguished by a uniform flow distribution with compact construction manner and high noise-damping being attained therewith. The flow courses or paths from the ventilator 9a to the filter 7a are extremely short as a consequence of the ring or annular channels or ducts 21a, 23a, so that only small or nominal flow losses and with that only a very small or nominal energy requirement will result. As a consequence of the ring or annular channels or ducts 21a, 23a, the walls can be comparatively low so that in addition to the advantage of small or nominal flow losses also an extremely compact construction embodiment of the unit 8a is attained. Since the ventilator 9 is arranged centrally, there results a uniform flow over the periphery or circumference of the ring or annular channels or ducts 21a and 23a.

Figure 6:
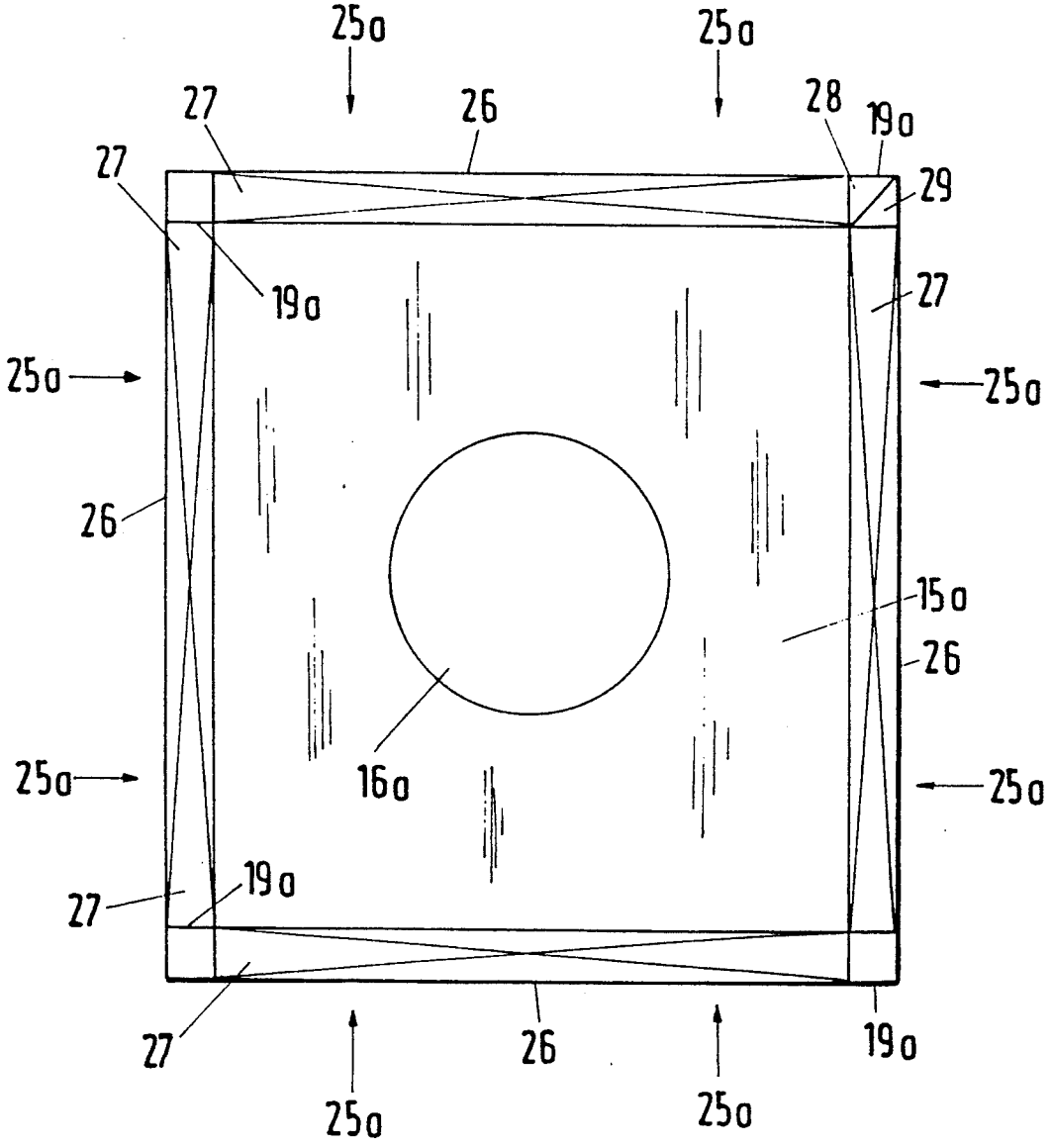
FIG. 6 is a view showing a section taken longitudinally of a line VI—VI in FIG. 5.

Since the cover or ceiling part 17a is supported only in the corner regions via the spacers 19a upon the cover part 15a, the returned air 25a as shown in FIG. 6, is suctioned on all sides of the ventilator 9a into the return air guide means 18a. Between these spacers 19a accordingly there are located inlet openings 26 into the return air guide means 18a. In these inlet openings 26 there is found a heat exchanger 27, via which the return air 25a is guided during entry into the return air guide means 18a. The heat exchanger 27 preferably is formed by a tube having cooling medium flowing therethrough, upon which laminations are seated or installed extending with spacing from each other and vertically or at right angles to the tube axis. The tube or pipe has a connection end 28 (FIG. 6) via which the particular cooling medium respectively flows into the pipe or tube of the heat exchanger 27. This tube extends over the entire circumference, scope or periphery of the cover or ceiling part 15a respectively 17a and adjacent to the connection end 28 having an outlet or discharge end 29 through which the cooling medium flows or discharges out of the tube. The cooling water is employed advantageously as the cooling medium. Naturally however also other cooling media can be employed, as for example cooling brine or refrigeration medium. If the return air 25a which flows out of the bottom-side return air guide means 4a flows upon entry into the return air guide means 18a via the heat exchanger 27, the same is cooled-off optimally. Since the heat exchanger 27 is located on the periphery or circumference of the unit 8a and with that having the greatest spacing from the ventilator 9a, here there occurs the smallest or most nominal impinging or flowing-in speed or velocity. Consequently the pressure loses likewise are very small or nominal. The unit 8a in spite of employment of the heat exchanger 27 has only small or nominal energy requirements.

Respectively according to the installation conditions there is noted that the heat exchanger 27 also can be arranged with spacing from the inlet openings 26 within the return air guide means 18a. In this situation however higher impinging or flowing-in speeds or velocities arise and with that higher pressure losses arise whereby the energy requirement of this unit is increased.

Basically it is possible to suction the return air 25a not from all sides. Accordingly only on one side of the unit 8a there can be provided an inlet opening 26 for the return air, while at the remaining sides between the two cover or ceiling parts 15a and 17a there can be provided a closed wall or a reduced free cross section. In this situation the heat exchanger 27 is provided only on one side of the unit 8a.

The return air guide means also can be so constructed and embodied that the return air 25a is not suctioned laterally into the return air guide means 18a but rather that the cover or ceiling part 17a at least provides one suction opening for the return air 25a. In this situation the suction openings in an advantageous manner are located in an edge region of the cover or ceiling part 17a. The heat exchanger 27 is then so arranged that the return air 25a must flow through the heat exchanger with its path or course to the ventilator 9a.

During flow-by or flowing past as to the heat exchanger 27, the return air 25a releases or gives off heat or warmth to the heat exchanger 27 and is hereby correspondingly cooled. The degree of cooling-off of the return air 25a is set or adjusted by the corresponding temperature of the cooling medium which flows through the heat exchanger.

In place of the cooling medium there can also be provided a warming or heating medium flowing through the heat exchanger 27 if this should be necessary for the particular respective employment situation of the filter-ventilator unit 8a.

In the illustrated sample embodiment the filter-ventilator unit 8a has two ring or annular channels or ducts 21a and 23a.

With a most simple and straight forward embodiment only a single ring or annular channel or duct is provided, which is bounded or limited by the outer wall 13a' and the inner wall 22a'. Such a unit 8a is constructed in an extremely compact manner and moreover additionally provides all advantages with respect to uniform flow distribution, the nominal flow losses and the very small or nominal energy requirement. If value is placed upon a high noise damping, again both walls 13a' and 22a' consist of noise-damping material. With small or nominal requirements as to noise damping it is adequate and sufficient if only the one boundary wall 13a' or 20a' is produced of noise-damping material.

The filter-ventilator-unit 8a also can have more than two ring or annular channels or ducts. In this situation correspondingly more walls are provided which are again so adjusted or attuned as to each other in the height thereof, that the wall height decreases from the outside to the inside. This gradation or stepping relationship is so selected that a uniform flow speed or velocity of the air is attained over the filter surface.

The units 8a accordingly with that can be adapted very simply and in a straight forward manner to the respective employment situation. All variations are characterized and distinguished by the uniform flow distribution, the compact manner of construction, the small or nominal flow loss, the small or nominal weight and by a very small or nominal energy requirement thereof.

The cover or ceiling 17a can lie or engage upon the heat exchanger 27, so that separate spacers 19a can be eliminated and not required. The cover or ceiling part 17a is arranged releasably so that the heat exchanger 27 can be easily interchanged or replaced respectively is easily accessible for maintenance-service work.

In the illustrated sample embodiment there is provided only a single heat exchanger 27. It is however also possible to provide several heat exchangers over the periphery or circumferential scope of the unit 8a. These heat exchangers can be connected in series one after the other and in sequence but also can be operated parallel with respect to each other. With parallel operation, every heat exchanger has an inlet and an outlet for the cooling medium or warming or heating medium.

In summary, the present invention concerns a filter-ventilator-arrangement for employment with clean space having at least one ventilator of which the pressure side is located toward an air flow chamber which is defined and limited by boundary walls. The flow chamber is formed by at least one annular channel 21, 23; 21a, 23a; of which two boundary walls 13a through 13d, 20a through 20d, 22a through 22d; 13a', 20a', 22a' includes one thereof consisting of noise-damping material.

Ventilator means 9, 9a is arranged preferably in one cover ceiling part 15, 15a, centrally in relation to an annular channel 21, 23; 21a, 23a.

The annular channel 21, 21a is limited or bounded upwardly by one outer wall 13, 13a of the device or unit 8, 8a therewith.

At least the outer boundary wall 13a through 13d; 13a' consists of noise-damping material.

The outer wall 13, 13a' of the unit 8, 8a extends as far as to the cover ceiling part 15, 15a.

The inner boundary wall 20a through 20d, 20a' has a spacing from the cover ceiling part 15, 15a.

The unit 8, 8a has several annular channels 21, 23; 21a, 23a of which the boundary walls 13a through 13d, 20a through 20d, 22a through 22d; 13a', 20a', 22a' decrease in height from the outside to the inside.

Each unit 8, 8a has at least one filter 7, 7a which is arranged in a region below the flow chamber 21, 23; 21a, 23a. The space or chamber surrounded by the innermost boundary walls 22a through 22d; 22a' is closed off against the filer 7, 7a.

The innermost boundary walls 22a through 22d; 22a' join against a plate 24, 24a with the inner sides thereof, which plate preferably consists of noise-damping material.

The cover ceiling part 15, 15a consists of noise-damping material and preferably forms the lower boundary of a return air guide means 18, 18a.

The return air guide means 18, 18a is limited upwardly by a further cover ceiling part 17, 17a, which preferably consists of noise-damping material.

A cooling air connection 11 is provided in a further cover ceiling part 17, which connection 11 is arranged at right angles preferably above the suction side of the ventilator.

The cooling air flowing through the cooling air connection 11 flows transversely, preferably at right angles, to the return air 25.

The unit 8, 8a is embodied and constructed as a module.

The boundary walls 13a through 13d, 20a through 20d, 22a through 22d; 13a', 20a', 22a', are arranged upon supports 14, 14a.

The boundary walls 13a through 13d, 20a through 20d, 22a through 22d; 13a', 20a', 22a', are secured hanging or extended in the cover ceiling part 15, 15a.

The annular channels 21, 23; 21a, 23a are located to lie coaxially with respect to each other.

The annular, channels 21, 23; 21a, 23a have square outline configuration.

The filter-ventilator-device or arrangement for employment with clean chambers includes at least one ventilator of which the pressure side is located toward an air flow chamber and the return air is suctioned by this ventilator from the clean chamber, and more particularly in the suction region of the ventilator 9a at least one heat exchanger 27 is located via which the return air 25a flows.

The heat exchanger 27 is arranged in a return air guide means 18a of the unit 8a.

The return air guide means 18a is arranged in a region above said ventilator 9a.

The heat exchanger 27 is arranged at one inlet opening 26 of the return air guide means 18a.

The heat exchanger 27 extends over the circumference of the unit 8a.

The heat exchanger 27 is arranged along an edge of the cover ceiling parts 15a, 17a in the return air guide means 18a.

The return air 25a flows in the same direction before and behind the heat exchanger 27.

The return air flows in different directions before and after the heat exchanger 27.

The heat exchanger 27 is arranged in a region below an inlet opening for the return air 25a in the return air guide means 18a within the return air guide means.

The heat exchanger 27 is an air cooler.

The heat exchanger 27 has a cooling medium flowing therethrough.

The heat exchanger 27 has a warming or heating medium flowing therethrough.

The present invention is, of course, in no way restricted to the specific disclosure of the specification and drawings, but also encompasses any modifications within the scope of the appended claims.

What we claim is:

1. A filter-ventilator-arrangement for employment with clean chambers, including at least one ventilator means having a pressure side located toward an air flow chamber means limited by boundary walls thereof, comprising said flow chamber means being formed by at least one annular duct means, of which at least one of two boundary walls consists of a noise-damping material, a ceiling part and a ventilator means located centrally thereof in relation to the annular duct means, and several annular duct means being provided and having boundary walls decreasing in height from outside to the inside.

2. An arrangement according to claim 1, in which said annular duct mean is limited outwardly by an outer boundary wall of the filter-ventilator-arrangement.

3. An arrangement according to claim 2, in which at least said outer boundary wall consists of noise-damping material.

4. An arrangement according to claim 2, in which said outer boundary wall of the filter ventilator arrangement extends as far as to said ceiling part.

5. An arrangement according to claim 1, in which an inner boundary wall has a spacing from said ceiling part.

6. An arrangement according to claim 1, in which at least one filter means is arranged in a location below a flow space formed by said annular duct means.

7. An arrangement according to claim 6, in which innermost boundary walls close off space against said filter means.

8. An arrangement according to claim 7, in which plate means adjoin said innermost boundary walls with inner sides thereof and said plate means consists of noise-damping material.

* * * * *

UNITED STATES PATENT AND TRADEMARK OFFICE

CERTIFICATE OF CORRECTION

PATENT NO. : 5,297,990

DATED : March 29, 1994

INVENTOR(S) : Manfred Renz and Helmut Bauer

It is certified that error appears in the above-identified patent and that said Letters Patent is hereby corrected as shown below:

On the title page, left column

Item [73] line 1, cancel "&" insert -- + -- (both occurrences).
Item [30] line 2, cancel "Japan" insert -- Federal Republic of Germany --.

Signed and Sealed this

Thirteenth Day of September, 1994

*Attest:*

*Attesting Officer*

BRUCE LEHMAN

*Commissioner of Patents and Trademarks*